US005751303A

United States Patent [19]

Erickson et al.

[11] Patent Number: 5,751,303

[45] Date of Patent: May 12, 1998

[54] PRINTING MEDIUM MANAGEMENT APPARATUS

[75] Inventors: Paul R. Erickson, Prior Lake; Brian W. Kleve, Bloomington, both of Minn.; Robert Schaffer, Canaan, N.H.; Steven L. Lidke, Chaska; Robert L. Skubic, Chanhassen, both of Minn.

[73] Assignee: Lasermaster Corporation, Eden Prairie, Minn.

[21] Appl. No.: 337,109

[22] Filed: Nov. 10, 1994

[51] Int. Cl.[6] ..... B41J 29/38

[52] U.S. Cl. ..... 347/16; 347/102; 347/104; 347/14; 347/88

[58] Field of Search ..... 347/16, 101, 102, 347/104, 88, 14; 219/216; 355/309, 311; 399/370, 389

[56] References Cited

U.S. PATENT DOCUMENTS

| | | | |
|---|---|---|---|
| 3,341,858 | 9/1967 | Loubier | 346/136 |
| 4,751,528 | 6/1988 | Spehrley, Jr. et al. | 346/140 R |
| 4,801,473 | 1/1989 | Creagh et al. | 427/164 |
| 4,853,706 | 8/1989 | Van Brimer et al. | 346/135.1 |
| 4,873,134 | 10/1989 | Fulton et al. | 428/156 |
| 4,877,676 | 10/1989 | Creagh et al. | 428/204 |
| 4,937,105 | 6/1990 | Sakai et al. | 427/366 |
| 4,951,067 | 8/1990 | Spehrley, Jr. | 346/140 R |
| 4,971,408 | 11/1990 | Hoisington et al. | 346/140 R |
| 4,982,207 | 1/1991 | Tunmore et al. | 346/138 |
| 5,005,025 | 4/1991 | Miyakawa et al. | 346/25 |
| 5,021,805 | 6/1991 | Imaizumi et al. | 346/76 R |
| 5,023,111 | 6/1991 | Fulton et al. | 427/164 |
| 5,041,846 | 8/1991 | Vincent et al. | 346/25 |
| 5,043,741 | 8/1991 | Spehrley, Jr. | 346/1.1 |
| 5,105,204 | 4/1992 | Hoisington et al. | 346/1.1 |
| 5,114,747 | 5/1992 | Fulton et al. | 427/164 |
| 5,182,571 | 1/1993 | Creagh et al. | 346/1.1 |
| 5,281,442 | 1/1994 | Fulton et al. | 427/374.5 |
| 5,323,176 | 6/1994 | Sugiura et al. | 346/25 |

FOREIGN PATENT DOCUMENTS

| | | | |
|---|---|---|---|
| 324223 | 7/1989 | European Pat. Off. | 347/102 |
| 62-167054 | 7/1987 | Japan | 347/102 |
| 2-179749 | 7/1990 | Japan | 347/102 |
| 5-84896 | 4/1993 | Japan | 347/102 |
| WO 88/08788 | 5/1988 | WIPO . | |
| 91/04799 | 4/1991 | WIPO | 347/102 |

*Primary Examiner*—John E. Barlow, Jr.
*Attorney, Agent, or Firm*—Paul H. McDowall; Kinney & Lange

[57] ABSTRACT

A hot melt ink jet printer capable of handling 54 inch media widths and printing at a minimum resolution of 300 dots per inch. The ink jet printer of the present invention includes a printing medium handling system for transporting the printing medium through the printer. The printing medium handling system includes a paper tensioning system for maintaining a constant tension in the printing medium as the printing medium is advanced past the print heads for imaging and also subsequently as the printing medium is post-image heated. A readable/writable memory unit accompanies the supply of printing medium and provides information indicative of the color characteristics, handling characteristics, and/or related characteristics associated with the printing medium for use by a controller at each important control point of the paper path. A controller, connected to the memory unit and responsive to the characteristics information, controls operation of the paper handling system throughout the entire imaging process.

29 Claims, 5 Drawing Sheets

20
50A–D
48
22
24
52
10
54
34
14
28
26
16
74
126
18
16
GRAVITY
27
Y
Z
X
12
16
16

PRINTING MEDIUM MANAGEMENT APPARATUS

BACKGROUND OF THE INVENTION

This invention relates to ink jet printing systems, and, more particularly, to a new and improved printing medium management system for very large format printers having a print platen greater than 36 inches wide. The new very large format printing medium management system addresses numerous problems of prior art printing medium management systems as well as numerous problems discovered in the design of very large format graphics quality digital imaging printers that use scanning ink jet print heads.

Ink jet printing involves placing a number of tiny ink droplets formed by one or more ink jets onto particular locations on the printing medium. The ink droplets solidify or dry on the printing medium, forming small dots. Any number of these small dots, when viewed some distance away from the paper, are perceived as a continuous-tone visual image. Both text and graphic images may be printed with ink jet printing.

The printed image from an ink jet printer is made up of a grid-like pattern of potential dot locations, called picture elements or "pixels". For many smaller format documents commonly viewed from 1–6 feet away, the ink jet printing industry has produced printers having a print resolution of between 200 and 300 pixels per inch (40,000 to 90,000 pixels per square inch at 300 dpi) and a maximum media width of 24 inches. The print resolution for other applications may vary as needed, and thus for printing a billboard, commonly viewed from hundreds of feet away, the pixel size may be on the order of 6–12 pixels per inch.

Color ink jet printers typically use the four subtractive primary colors: cyan, yellow, magenta and black ("CYMK"). Color blending of these four ink colors is achieved through two mechanisms. First, the ink jet printer may lay down multiple colors of ink on the same pixel location, thus combining ink colors at that pixel. The particular color combination caused by having multiple ink colors at a particular pixel location may be affected by the order of printing the various colors, as well as the homogeneity (or non-homogeneity) of ink mixing.

Second, when viewed at a distance, the eye will blend colors from adjacent pixel locations. Thus, for instance, a number of exclusively magenta and yellow dots may be laid down in an area of the image, with no pixel location receiving two colors of ink. Rather than perceiving individual magenta and yellow dots, the eye will blend the adjacent dots to perceive an orange image. In practice, ink jet color printers use both ink blending at particular pixel locations and perception blending across pixel locations to create various colors and shades. Often a substantial number of the pixels of the image will go without having a dot of ink placed on them. This allows the perceived visual image to have a proper lightness/darkness value. Through both forms of color blending, ink jet printers using only four colors of ink can visually reproduce full color images.

Presently there are two primary types of jets which can be used in ink jet printers—thermal jets and piezo-electric jets. Thermal ink jets use a thin film resistor to vaporize a small portion of ink and create a minute bubble within the ink. The bubble forces a small droplet of ink through the jet nozzle. Piezo-electric jets use a substrate which is electrically pulsed to create a pressure wave in the ink. The pressure wave in turn shoots a droplet of ink through the jet nozzle. A method of making a piezo-electric ink jet is taught in U.S. Pat. No. 5,265,315 by Hoisington et al., which is incorporated herein by reference.

Ink jet printers may further be classified as "on demand" or "continuous" type printers. "On demand" printers form ink droplets only for the particular pixel locations needed. "Continuous" printers form droplets at each pixel location, but some droplets are deflected away before they contact the paper.

Ink jet printer systems may use one or more of several different types of ink. Some ink jet printers utilize aqueous inks prepared with water or other solvents which are liquid at room temperature but dry after the ink has been applied to the printing medium. Ink jet systems may alternatively use "hot melt" inks which contain little or no solvent and are solid at room temperature but is applied in a heated liquid state and then effectively frozen onto the paper surface. Ink jet systems also may alternatively use semi-liquid or semi-solid inks, which are semi-liquid or semi-solid at room temperature but are liquefied when heated. Such non-aqueous inks are generally known as "phase-change" inks. The heated ink is propelled onto the printing medium in a manner similar to an aqueous ink. The ink cools and congeals or solidifies immediately upon contact with the paper. The printing medium management system of the present invention applies equally to all these various types of ink jet printers, but is particularly contemplated for ink jet printing using non-aqueous, phase-change inks such as hot melt inks. One such hot melt ink is taught in U.S. patent application Ser. No. 08/337,295, U.S. Pat. No. 5,574,078, entitled THERMAL COMPOSITIONS by Elwakil filed on even date herewith and assigned to the assignee of the present invention and expressly incorporated herein by reference.

An advantage of phase change ink jet printers is that such printers can print on many different types of printing media. The phase change ink typically solidifies or congeals on the medium surface within three to five milliseconds of contact. The rapid congealing or solidification of the phase change ink prevents immediate absorption and penetration of the ink into the printing medium. Because the phase change ink solidifies or congeals upon contact with the medium surface, problems with the ink bleeding into the printing medium in an uncontrolled manner are greatly reduced. This results in unique opportunities for controlling graphics quality, color reproduction, and work piece throughput for very large format, high throughput digital printing systems.

However, special problems exist with hot melt ink jet printers. The rapid solidification of the ink produces raised ink droplets and images with rough surfaces having an embossed appearance. The raised and bumpy surface that results is undesirable for a variety of reasons. Such ink droplets or images may have poor adhesion to the printing medium, may easily be scrapped off or flake off by the action of folding or creasing the printing medium, or may be subject to smearing or off-setting to other sheets. Further, raised images having an embossed appearance diffract light at various angles which may result in color or hue variations to the viewer. Additionally, different printing media will produce color variations when used with a given ink. Color variations between different media may be due to differences in the printing medium composition, the presence of a coating on the medium, the porosity of the medium, or the like. While the variations in color may be considered negligible in some applications, even minor color variations are unacceptable in many instances for graphics quality, large format printers. For this reason, it is desired to control the printer, the printing medium, and the ink, such that it is possible to accurately reproduce a desired color with any given printing medium.

One means for addressing the problem of a raised or bumpy image surface due to rapid ink solidification has been to provide a heated platen which heats the media and causes the ink to solidify more slowly, thereby allowing the ink to slightly spread on the printing medium. Such a solution is illustrated in U.S. Pat. No. 4,751,528 by Speahrley, Jr., et al. and U.S. Pat. No. 5,043,741 by Speahrley, Jr. However, the use of a platen which heats the printing medium to a temperature sufficient to allow the ink to spread and surface-bond with the medium causes other problems as the medium moves across the platen in the print zone. One such problem relates to differential thermal expansion of film media (e.g., Mylar) and another relates to differential shrinkage of fibrous media (e.g., paper) as it is heated and dried by the platen. In the case of fibrous printing medium, such as paper, as the medium passes over the heated platen the moisture content of the paper changes as moisture is driven out, and the fibers tend to shrink. The shrinking of the fibers is typically not uniform and causes waves or ripples known as cockles to form in the paper. Cockling results in a poor thermal connection between the paper and the platen which further aggravates differential shrinkage of the printing medium and non-uniform spreading of the melted ink due to uneven heating. The non-uniform spreading of the ink results in poor or incorrect color reproduction. To aid in keeping the printing medium in contact with the heated platen, U.S. Pat. No. 4,751,528 uses a vacuum to pull the media against the platen. Cockling also causes inaccurate ink dot placement by changing the point of impact of the jetted ink droplets. Because the surface of the printing medium is no longer smooth or even, the drops of ink expelled by the print head do not impact the printing medium at the proper points. Images imprinted on a cockled medium have a "banded" appearance due to the variations in the printing medium surface height.

Use of a heated platen has other difficulties as well. Maintaining a constant temperature is difficult, because as the rate at which hot melt ink is applied to the substrate changes, the heat transfer to and from the heated platen also changes. Widely varying heat fluxes make temperature control difficult, and as illustrated in U.S. Pat. No. 4,751,528 by Speahrley et al., the platen must be capable of being both heated and cooled to maintain a constant temperature for even ink drop spreading to occur.

Additional methods of dealing with the raised or bumpy surface caused by rapid ink solidification include flattening the image by using a roller to apply pressure to the ink on the printed surface as shown in U.S. Pat. No. 4,745,420 by Gerstenmaier. However, the applicator of pressure to a raised or bumpy surface to flatten the surface causes only the tops of the ink bumps to be flattened, and does not cause the ink to spread and bond with the print media. Additionally, as the width of the printed image is increased, an impractically large force is required to create the necessary pressure across the surface of a very large format printing medium to cause the ink dots to flatten. It is also known in the case of transparencies for overhead projectors to increase the radius of curvature of the ink drop and thereby reduce the scattering of light passing through the ink drop by maintaining the ink at a temperature above its melting point long enough to cause the ink to flow on the surface of the substrate, as shown in U.S. Pat. No. 4,873,134 by Fulton et al. For porous substrates, as shown in U.S. Pat. No. 5,105,204 by Hoisington, it is known to use radiant heat to remelt an image formed from hot melt ink and then to quickly quench the ink to prevent crystallizing of the ink.

For all of the above methods of smoothing the raised and bumpy image surface caused by rapid ink solidification, unique problems are encountered when they are used to create very large format graphics quality images. As noted above, flattening rollers do not improve the ink's bond with the media and spread the ink, but rather only flatten the tops of the ink bumps. As the media width increases, the forces required to create the necessary "crushing" pressure become very large and are impractical for use in a commercial printer apparatus. Use of a heated platen requires very accurate temperature control which becomes more difficult as media width increases, because the temperature must be maintained in a narrow range over a longer span and because the heat transfer from the large amounts of ink being used varies greatly over the width of the media. When conductive heating sources are used, it becomes increasingly difficult to maintain even contact between the media and the heater as the width of the media increases, and thus uneven heating results. In all cases, uneven heating of the ink and printing medium causes non-uniform color reproduction in an image, often appearing as banding or other visible imperfections which are unacceptable for the production of graphics quality images. In addition, for very large format graphics quality printing using different media types, processing of the printed image requires a specific recipe for each media type, including media advance speed, temperature, and web tension. The means for reducing or eliminating the raised or bumpy image surface must therefore be variable and accurately controllable to achieve high quality output.

As discussed above, heating of a fibrous printing medium may result in cockling of the media. To reduce cockling problems, it is known that a curved platen configuration may be used. Such a platen configuration is illustrated in U.S. Pat. No. 4,751,528 to Speahrley, Jr., et al. In Speahrley, a curved platen causes the paper to be held in a curved configuration and thereby stiffened against buckling and cockling. However, the use of a curved platen alone is not always sufficient to reduce cockling and produce acceptable printed images. Therefore, the printing medium may additionally be placed under tension to further inhibit cockling of the media.

Ink jet printers generally move a print head containing the ink jets horizontally across the print image, while advancing the paper lengthwise between successive passes or scans of the print head. To increase the rate of printing, numerous jets per color have been used to create a wider print head "swath". Prior ink jet color printers have utilized a single head having 64 linearly aligned jets. To print with four (CYMK) colors, four sets of 16 adjacent jets are each supplied with one of the ink colors to print 16 rows of pixels of each color. Each jet is vertically offset one pixel from the adjacent jets. With this previous 64-jet printer, the paper advance is 16 pixels after each scan (i.e., one quarter of the width of the 64 pixel print stroke), such that each scan of the printer head orients a jet of another ink color over each pixel row printed in a prior color.

Ideally, ink jet printing would occur by vertically-aligned (i.e., aligned in the direction of paper travel, perpendicular to the direction of print head travel) printer jets each mounted one pixel beneath the preceding jet. However, present printer head technology limits the minimal spacing between jets. For instance, piezo-electric jets of the type discussed in U.S. Pat. No. 5,265,315 to Hoisington et al. are presently limited to approximately 0.027 inches spacing between adjacent jets, or approximately 37 jets per linear inch. Ink reservoir/firing chamber space is presently the critical factor in preventing closer spacing. To attain 37 jets per linear inch spacing, chambers are alternately located above and below the jets. Resolution of 37 dots per inch is quite unsatisfactory in reproducing closely-viewed visual images at sufficient resolution to produce a pleasing visual effect, such as for graphics quality, large format ink jet printers.

To achieve a higher print resolution, prior art linear jet arrays have been oriented at an angle in relation to the direction of print head travel, known as the "saber angle." By angling the linear jet array, the vertical spacing between jets becomes smaller, and the resolution of the resulting image is increased.

To meet the minimal required resolution of 300 dots per inch, the line of jets has been angled such that each jet is positioned approximately 1/300th of an inch vertically beneath the preceding jet. It should be noted that the horizontal spacing between jets should be a multiple of the vertical spacing between pixel rows, to aid in developing a grid pattern of pixel locations having matching horizontal and vertical resolutions. Because the vertical spacing between pixel rows is 1/300th of an inch, the horizontal spacing between jets should be a multiple of 1/300ths of an inch. Given the spacing constraint of 0.027 inches between the jets, 1/300th of an inch vertical spacing leads to a horizontal spacing between jets of 8/300th of an inch. The "saber angle" of the line of jets is at a ratio of 8 to 1 and an angle of 7.125°. This is the saber angle presently being used for prior art hot melt ink jet printers.

Prior art scanning print head configurations, with numerous jets per color each mounted one pixel beneath the previous jet and printing in a full swath, predicate what is known as a "banding" problem. One type of banding occurs if the paper advance is not extremely accurate, such that the paper is advanced slightly more or slightly less than the width of the print "swath" or stroke (i.e., the vertical extent of the line of jets). That is, if the paper advances slightly too far, a perceptible blank area will occur in the color pattern at the end of each paper advance between the printed swaths. Alternatively, if the paper advance is too short, a perceptible darker area will occur in the color pattern at the beginning of each paper advance, where adjoining swaths overlap. Other types of banding may also appear in a printed image. The direction that the print head is traveling for any given scan may affect the order that the different colors of ink are deposited on the paper, or thermal transfer from the hot ink to the media may affect the ink flow characteristics and result in visible banding in the image. These additional types of banding are further described in U.S. patent application Ser. No. 08/337,073 entitled INK JET PRINTER WITH MULTIPLE PRINT HEADS by Lukis et al., filed on even date herewith and assigned to the assignee of the present invention and expressly incorporated herein by reference.

The banding error which occurs when advancing the printing medium is often due to variations in the type of printing medium used in the printer. Different media types have different handling characteristics and will react to exposure to heat, ink, and tensioning forces in a variety of different ways. Variations in the thickness and stiffness of two different printing media may result in different feed rates through the printer. For example, a printing medium is typically advanced through the printer by a drive motor which rotates one or more drive wheels that contact the printing medium. The printing medium is typically forced against the drive wheel by a pinch roller or other suitable mechanism. In the prior art, the drive wheel is typically formed from or has at its outer surface a hard rubber material suitable for gripping and advancing the medium. Depending upon the thickness, stiffness, friction coefficient of the paper, and force exerted on the pinch roller by the printing medium, the rubber surface of the drive wheel is deflected by varying amounts. This deflection phenomenon results in a slight increase in throughput speed of the medium, due to compression forces applied to the medium and drive wheel from the pinch roller. Therefore, the distance which the drive wheel advances any given media for any given number of rotations of the drive wheel is increased. The deflection phenomenon thus results in different rates of advancement for two different printing mediums.

Another type of banding may be caused by changes in the tension of the printing medium. In particular, the advancement of the printing medium by the drive rollers is effected by the differential tension across the nip point between the drive roller and the pinch roller. That is, the magnitude of the difference between the tension in the printing medium on the supply side of the nip point and the tension in the printing medium on the take-up side of the nip point affects the rate at which the printing medium is advanced by the drive rollers. If the differential tension across the nip point continuously changes, the rate of advancement of the printing medium will also continuously change.

Various methods have been attempted to compensate for the above-cited banding problems. For instance, in U.S. Pat. 5,075,689 to Hoisington, et al, banding was addressed by altering the arrangement of print jets out of a linear array. Another approach to preventing banding, taught by U.S. Pat. No. 5,239,312 to Merna, et al., involves altering the spacing between jets on a print head. Both of these previous methods involve additional manufacturing costs in aligning the ink jets into a non-uniform pattern.

A third approach to banding is referred to as "multipass" printing. In multipass printing, the print media is advanced at a fractional increment of the vertical swath width, such that two or more jets of the same color pass over a pixel row on subsequent passes. This first jet will only print a portion of the dots on that pixel row, with remaining dots on the pixel row printed on subsequent passes. Multipass printing tends to mask paper advance errors such that they do not show up as discreet artifacts in the print output, but requires significant additional time in printing.

As described above, current ink jet printing systems have several problems relating to the handling of the medium upon which the image is printed. These problems include banding caused by inaccurate advancement of the medium through the printer, inaccurate color reproduction, and cockling of the medium. The severity of these problems is largely a function of the handling characteristics (thickness, stiffness, surface coatings, etc.) of the particular printing medium being used in the printer. Different printing mediums will react to exposure to heat, hot melt ink, and tensioning forces very differently. Because it is desirable to have the ability to use a variety of printing mediums in a single printer, media-handling variables such as feed rates and tensioning forces as well as image processing such as heating of the ink on the media must be controllable to obtain accurate image and color reproduction for each type of printing medium used. In early printing systems, mechanical controls were used to tension the printing medium, set the feed rate, adjust color imbalances, etc. In later prior art printing systems, similar operational settings were performed with a software user-interface that let the user select values representing mechanical and operational settings. In both of the above described types of systems, some active intervention was required by the user to adjust the printing system to create an accurate image. It is therefore desired to produce an ink jet printing system which is capable of automatically adjusting itself to ensure proper printing medium advancement, accurate color reproduction, and minimal cockling. Finally, the printing medium handling system must be capable of working equally well with a variety of printing mediums to minimize banding and cockling problems.

SUMMARY OF THE INVENTION

The present invention is a hot melt ink jet printer capable of handling 54 inch media widths and printing at a minimum resolution of 300 dots per inch. The ink jet printer of the present invention includes a printing medium handling system for transporting the printing medium through the printer. The printing medium handling system includes a tensioning system for maintaining a constant tension in the printing medium as the printing medium is advanced past the print heads and also as the printing medium is heated. In the preferred embodiment of the present invention, a plurality of hard aluminum drive wheels are used to reduce variations in media advancement caused by the deflection of the drive wheels. The drive wheels are coated at the tread surface with tungsten-carbide alloy applied using a high granularity heat-sputtering process to provide a "gritted" tread surface, which further reduces deflection phenomenon. A readable and writable storage unit, called a media profiler, accompanies the supply of printing medium and provides information indicative of the handling characteristics and/or other characteristics associated with the printing medium. A controller, connected to the media profiler and responsive to the medium characteristics information, controls operation of the paper handling system for the media type.

In preferred embodiments, the controller controls the operation of the paper handling system so that the printing medium is advanced accurately under a constant tension for each media type used by the printer. In other preferred embodiments, the controller monitors the printing medium remaining on the supply roll and is capable of warning the user of an inadequate printing medium supply.

DETAILED DESCRIPTION OF THE PREFERRED EMBODIMENTS

Figure 1:
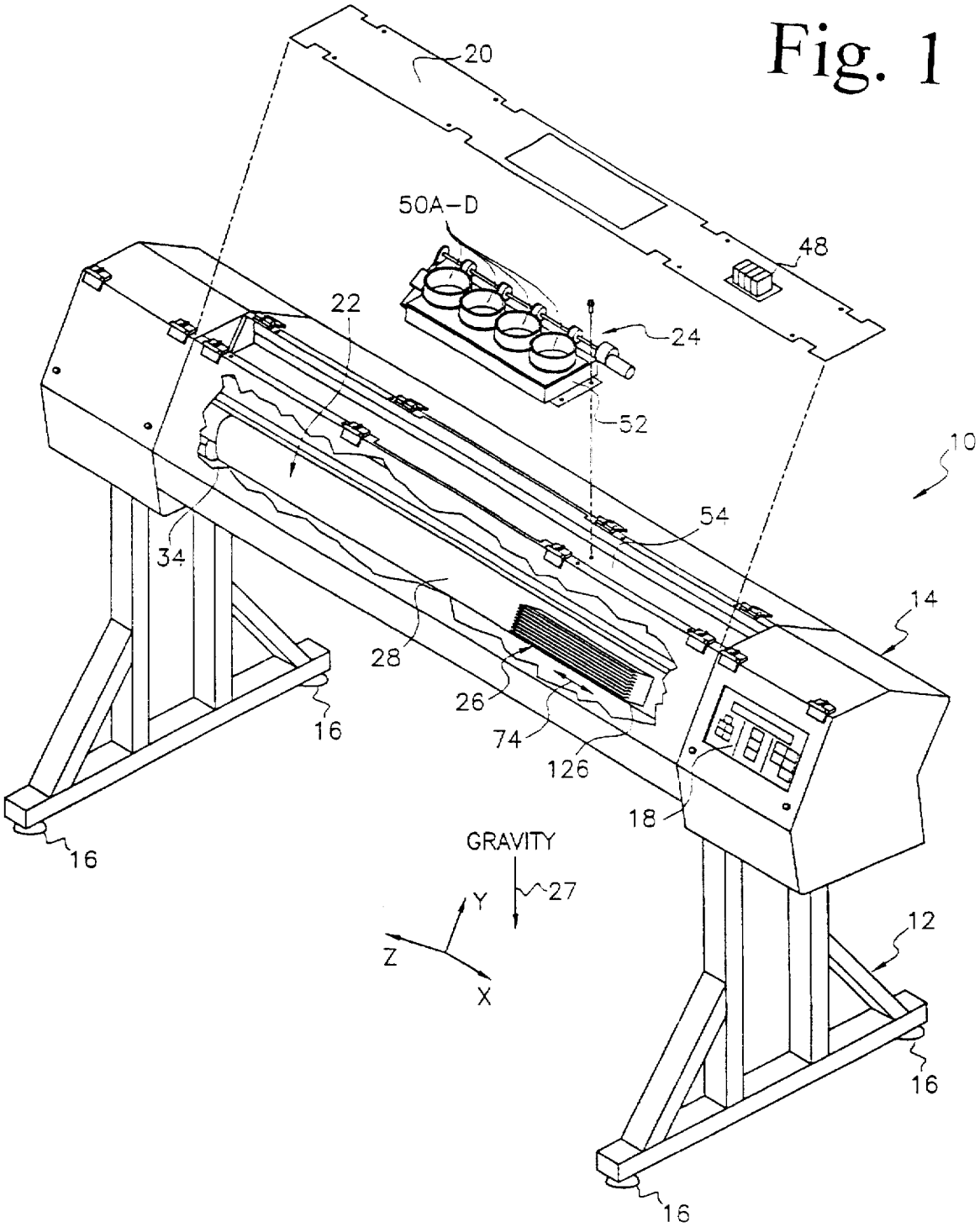
FIG. 1 is a perspective view of the printer apparatus of the present invention.

FIG. 1 shows an overall perspective view of printer 10. As shown in FIG. 1, printer 10 includes stand 12 and housing 14. Stand 12 includes adjustable feet 16 for levelling printer 10. Housing 14 includes control pad 18 and cover 20. Cover 20 may be removable for access to the internal components, and may be transparent in part to allow viewing of the printing operation. Workers skilled in the art will appreciate that various structures can be used to house printer 10 and the internal components therein. Internal to housing 14, (as shown by the broken out segment of FIG. 1), printer 10 includes paper handling system 22, ink supply system 24 and print head system 26 to print on paper or printing medium 28. To simplify the description herein, printing medium 28 will be referred to as paper 28, but workers skilled in the art will appreciate that the printing medium can be any substance capable of receiving ink printing, such as paper, film (e.g., MYLAR), plastic, foil, cloth, vinyl, canvas, etc.

Figure 2:
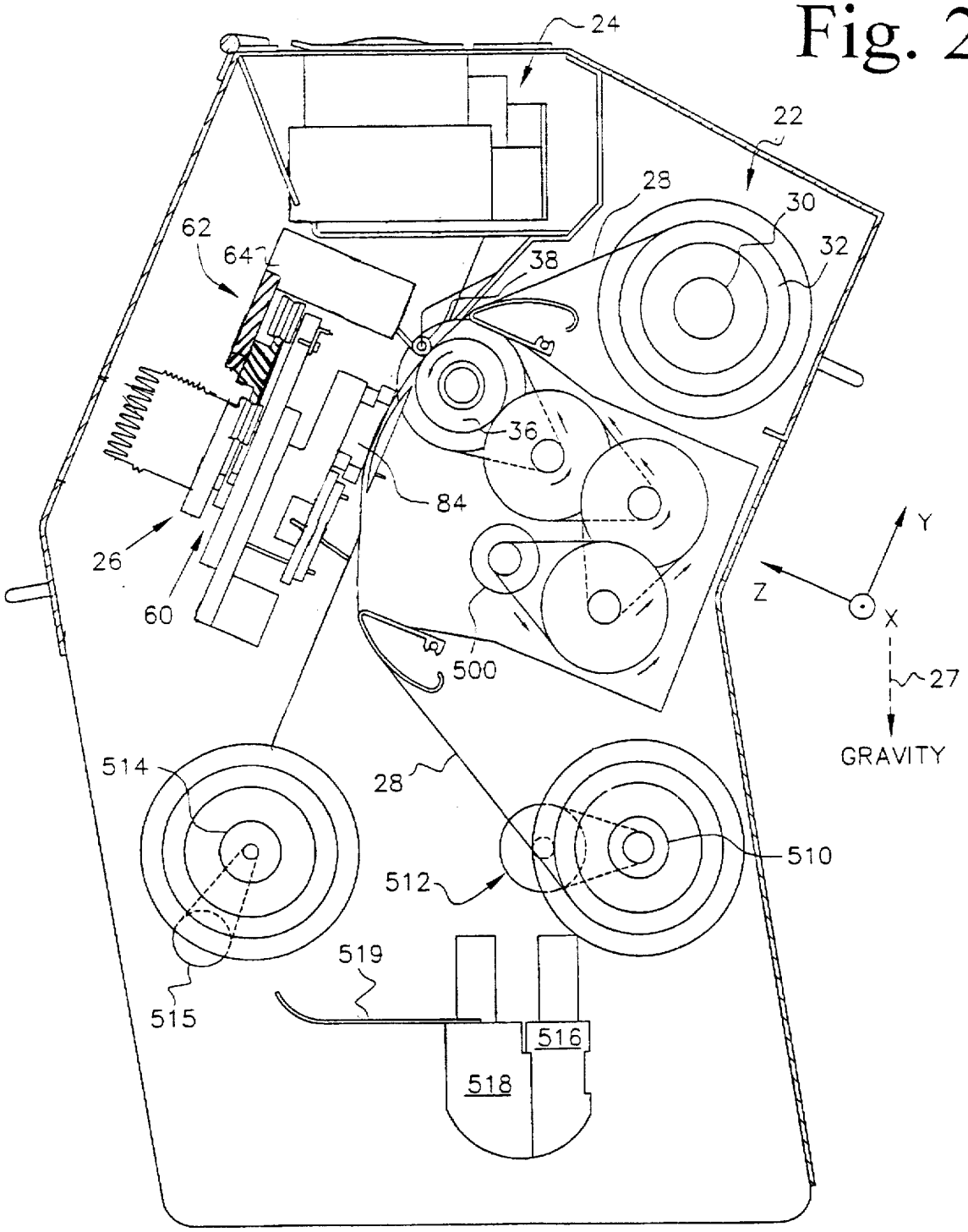
FIG. 2 is a side view of the ink jet printer of FIG. 1 showing the relative orientation of the print head system, paper handling system, and ink supply system.

FIG. 2 shows a broad side view of the various paper handling 22, ink supply 24 and print head 26 systems. As indicated by directional reference 27, these internal systems generally operate at an angle relative to vertical. X, Y and Z axes are shown, with print head travel occurring along the X-axis, paper 28 travel occurring perpendicular to the X-axis and along the Y-axis, and the Z-axis being defined perpendicular to both the X-axis and the Y-axis. Printing can occur in any directional orientation of printer 10, but the orientation shown by directional reference 27 is preferred both for gravitational effects and for permitting viewing of the printing operation. As shown, the x-y plane is preferably disposed at an angle of 10 to 30 degrees to vertical.

As best shown in FIG. 1, ink supply system 24 includes ink profiler 48, four individual upper reservoirs 50A–50D and lower reservoir assembly 52. Lower reservoir assembly 52 includes four individual lower reservoirs (not individually shown). The ink profiler 48 and ink reservoirs 50, 52 may be supported on horizontal shelf 54 on the outside of the printer housing. Ink supply system 24 includes further transport and treatment apparatus (not shown) to properly provide ink to print head system 26. Ink supply system 24 is described in further detail in U.S. patent application Ser. No. 08/337,307 entitled LARGE FORMAT INK JET PRINTER AND INK SUPPLY SYSTEM by Erickson et al., filed on even date herewith and assigned to the assignee of the present invention and expressly incorporated herein by reference.

Print head system 26 includes carriage assembly 60 (shown in FIG. 2), rail assembly 62, and peripherals, such as drive motor assembly 64. Carriage assembly 60 is mounted to a drive belt (not shown), and the drive belt is driven by drive motor assembly 64. Carriage assembly 60 is propelled back and forth (i.e., in the positive and negative x-directions) along rail assembly 62 by drive motor 64 and the drive belt. Workers skilled in the art will appreciate that drive motor assembly 64 can be designed to appropriately control travel of carriage assembly 60. In the preferred embodiment, the drive belt runs in a full loop in the x-direction. Good acceleration, deceleration and accuracy characteristics of drive motor 64 and the drive belt is important for adequate printing performance. The x-direction length of travel of carriage assembly 60 must be sufficient to transport carriage assembly 60 across the entire width of the printed image area and to any peripheral devices which may be mounted off to the side of paper 28 such as a print head maintenance station. An umbilical assembly (not shown) is connected between carriage assembly 60 and printer 10 to provide carriage assembly 60 and print heads 84 with ink and electrical signal supplies. Print head system 26 is described in further detail in U.S. patent application Ser. No. 08/337,073 entitled INK JET PRINTER WITH MULTIPLE PRINT HEADS by Lukis et al.

Figure 3:
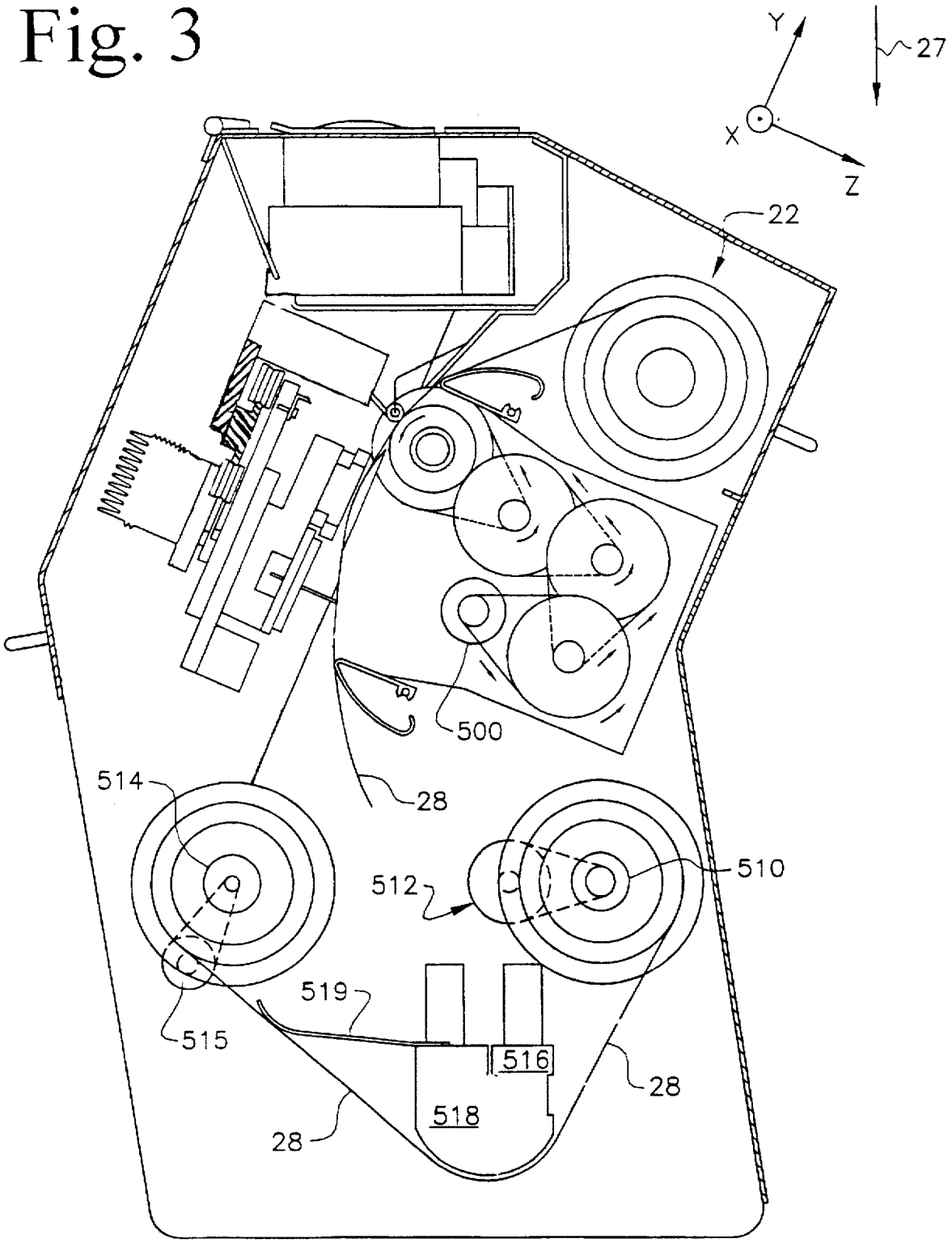
FIG. 3 is a side view of the ink jet printer of FIG. 1 showing the printing medium during a post-heating operation.

As best seen in FIGS. 2 and 3, paper handling system 22 begins with supply spool 30 for holding paper supply roll 32. Paper 28 travels from supply spool 30 past a plurality of drive rollers 36 and a corresponding plurality of pinch rollers 38. The drive rollers 36 are rotated by a drive motor 500. The drive motor 500 is preferably a servo-motor with an integral rotary optical encoder for position-feedback sensing. The rotary optical encoder preferably provides a resolution of 200 positions per revolution of the servo motor armature and provides quadrature read-out of the rotary encoder disk, which increases position feedback resolution to 2000 positions per revolution (500 ppr×4=2000 ppr). Thus, the servo-motor provides accurate mechanical positioning of paper 28 in much the same way as a "stepper" motor. That is, the servo-motor produces a known angular rotation by "stepping" from one angular position to another a known number of positional advances as determined from the integral rotary optical encoder. By "stepping" drive motor 500 a predetermined number of "steps" using a servo-motor, paper 28 can be accurately advanced a known distance. The higher-speed servo-motor advances paper 28 at a much faster rate than traditional "stepper" motors can achieve.

Paper 28 continues past print heads 84 to tensioning spool 510. Tensioning spool 510 is an intermediate take-up spool which is controlled by tensioning apparatus 512. Tensioning spool 510 and tensioning apparatus 512 provide a uniform web tension across the entire width of paper 28 as paper 28 is wound about tensioning spool 510.

As best seen in FIG. 3, after an image is printed on paper 28 and the portion of paper 28 containing the printed image is wound onto intermediate tensioning spool 510, paper 28 is cut. Paper 28 is then attached to take-up spool 514 such that paper 28 contacts heater 516 and quencher 518 as paper 28 travels from tensioning spool 510 to take-up spool 514. Take-up drive motor 515 rotates take-up spool 514. Tensioning fingers 519 extend from quencher 518 and exert light pressure on paper 28 to ensure no slack exists in paper 28 such that paper 28 stays in continuous and even contact with heater 516 and quencher 518.

The separate processes of printing the image on paper 28 and heating the printed image are performed in a serial manner to optimize the image throughput speed of paper 28 in each process. The components of paper handling system 22 are arranged such that the image printed on paper 28 is not touched during the separate printing and heating processes. In particular, drive rollers 36 and pinch rollers 38 are located such that paper 28 is "pushed" past print heads 84 rather than "pulled" past the print heads. By placing drive rollers 36 and pinch rollers 38 in an "upstream" location from print heads 84, no drive wheels or rollers need contact the printed image after it has been created on paper 28. Similarly, the orientation of heater 516 and quencher 518 is such that the side of paper 28 containing the printed image does not contact the surfaces of heater 516 or quencher 518 which could damage the printed image. Minimizing contact with the printed image before the image has been heated is especially important when using hot melt ink, as the ink may be scraped off or flake off the paper 28 prior to heating by scuffing or rubbing.

When printing high quality color images, it is important that a printing system be able to accurately and consistently produce an image and reproduce the colors contained in the image. However, as previously noted, there are many different types of printing mediums which may be used. Different printing mediums have different handling characteristics (media thickness, stiffness, feed rates, coatings, calorimetric effects on color reproduction, etc.) and will react to exposure to heat, different types of ink, and tensioning forces quite differently. The differences between printing mediums can lead to problems such as cockling of the media, or banding effects in the printed image. Therefore, to accurately and consistently produce a printed image, it is important that several parameters be known and monitored during the printing process. These parameters include the printing medium characteristics such as the media type (e.g., coated matte paper, coated glossy paper, translucent film, clear film, vinyl, canvass, etc.), media dimensions, and the amount of the printing medium available to be printed on. The particular printing medium characteristics are used in the control of the media speed and tension, the heating and cooling profiles of the media, and many other printer operations which may be affected by the media characteristics.

To ensure consistent and accurate results, it is desirable to eliminate as many sources of potential error as possible from the printing process. One potential error source is user error, which occurs when a user adjusts the printing system to accommodate different printing mediums. It is therefore preferable to eliminate the requirement that a user set controls or choose input data regarding operation of the printer for a given printing medium when printing an image. To accomplish this, it is important that the printer be able to determine the characteristics of the printing medium and ink which is being used and to automatically adjust itself accordingly to achieve the desired results. For example, to accurately reproduce a particular color on two different printing mediums, it may be necessary for the printer to adjust the manner in which the ink is placed on the two printing mediums. A slight variation in the amount or combination of inks which are used may be necessary, the feed rate of the medium through the printer may require adjustment, the tension on the medium may need to be modified, or the heating and cooling profile of the printed image may need to be altered. It is preferred that the printer be capable of making such adjustments without requiring any input from the user and thus eliminate user error as one potential source of error.

The ink jet printer 10 of the present invention addresses the need to recognize and monitor the printing medium and the ink, and to automatically adjust the operation of the printer in response to the type of printing medium and ink being used. A storage or memory unit called a media profiler 530 (schematically shown in FIG. 4) contains information which is desired or necessary for adjusting operation of printer 10. Media profiler 530 may comprise any device capable of storing and providing information indicative of characteristics of the printing medium, such that one printing medium may be identified and distinguished from a plurality of media. For example, media profiler 530 may comprise a switch array, fuse logic, a read only memory (ROM) unit, or a readable and writable memory unit. The media profiler 530 preferably accompanies each new supply of paper 28 and is preferably disposable when the printing medium supply is exhausted. When a new supply of paper 28 is mounted on supply spool 30, the accompanying media profiler 530 is coupled to controller 532 by an interfacing link. Media profiler 530 thus may communicate with controller 532 in printer 10, such that the information stored in media profiler 530 may be retrieved, used and modified by controller 532.

Figure 4:
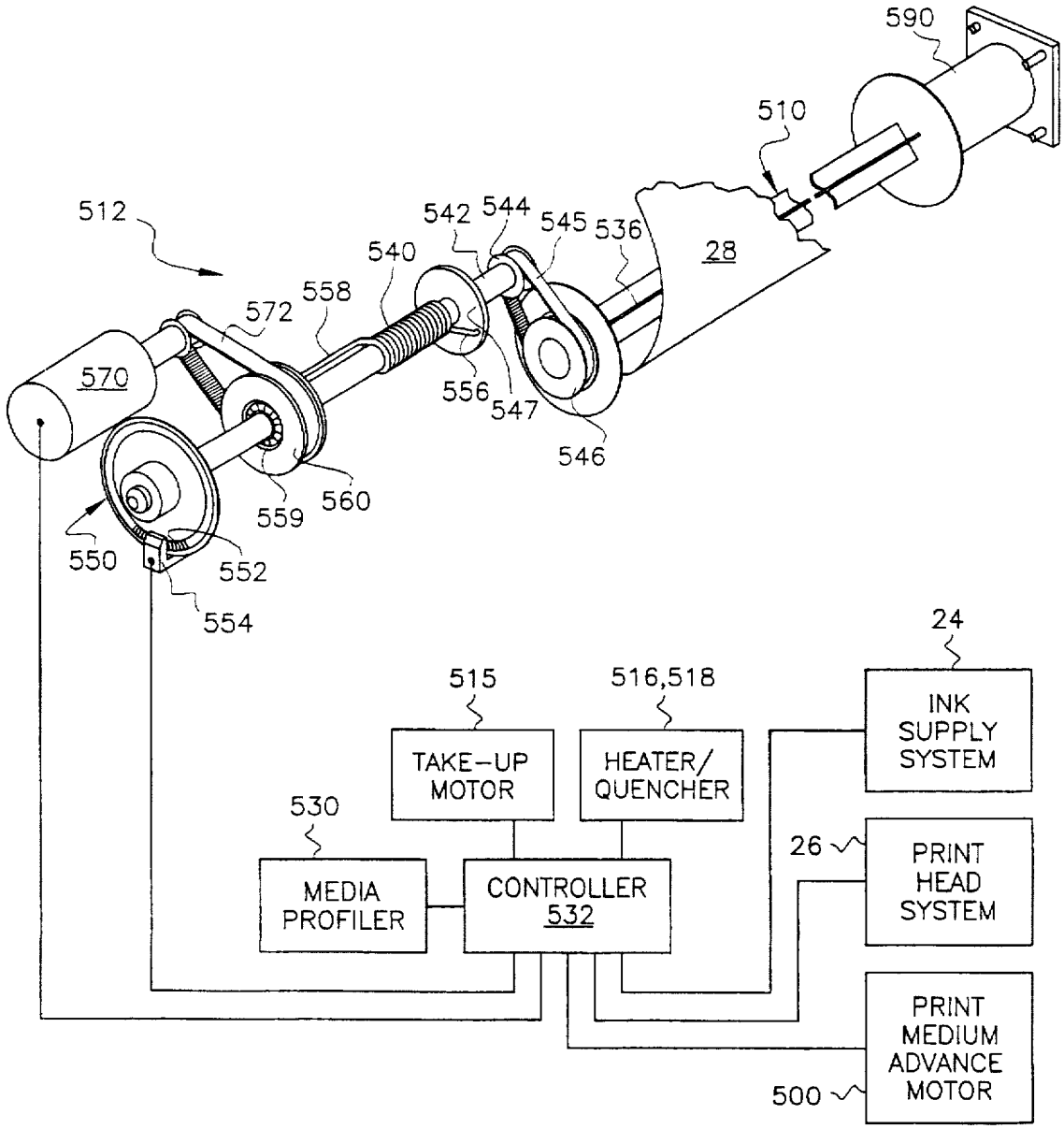
FIG. 4 is a schematic view of the paper tensioning apparatus of the present invention.

As seen schematically in FIG. 4, controller 532 is in electrical communication with all systems of printer 10, including ink supply system 24, print head system 26, media advance motor 500, tensioning apparatus 512, heater 516, quencher 518, and take-up motor 515. While media profiler 530 is described herein as a separate unit which accompanies the printing medium, those skilled in the art will recognize that media profiler 530 may alternatively be formed as an integral part of the media supply. For example, media profiler 530 may be integrally formed as part of the media supply spool 30.

The information stored by media profiler 530 is preferably indicative of characteristics of paper 28 such as, for example, the type of paper 28 (e.g., matte coated, glossy coated, etc.), the dimensions of the printing medium (e.g., thickness, width, length), and any other information necessary for controller 532 to properly identify the media and operate the printer. The data contained in media profiler 530 is used by printer controller 532 for multiple purposes, including creating the proper tension in paper 28, determining the proper advancement of the paper 28 through the printer, and controlling the heating and cooling of the image to accurately reproduce colors in the printed image.

As noted above, media profiler 530 may comprise any of a variety of devices capable of storing information identifying and distinguishing one printing medium from a plurality of printing media. In some instances, media profiler 530 may have a storage capacity large enough to store the actual characteristics of a printing medium which are necessary for operation of printer 10. In most instances, however, the storage capacity of media profiler 530 will not be large enough to store the actual characteristics of the printing medium. For this reason, it is preferred that media profiler 530 provides information indicative of characteristics associated with the printing medium.

In a preferred embodiment, controller 532 includes a look-up table containing the parameters of operation for printer 10 for each of a plurality of printing media. For a particular printing medium, the look-up table contains parameters, for example, such as printing medium advancement speed, printing medium tension, and printing medium heating profile which are dependent on characteristics associated with the printing medium. Media profiler 530 indicates to controller 532 which particular printing medium is being supplied to printer 10, and controller 532 then uses information in the look-up table associated with the particular printing medium to operate printer 10. In this manner, media profiler 530 may be made of less expensive devices, thereby reducing the cost of printer 10.

In a preferred embodiment, media profiler 530 is readable and writable memory unit such that controller 532 may modify some information in media profiler 530. For example, media profiler 532 preferably provides information indicating the length of printing medium available for use. Preferably, controller 532 is capable of modifying the information in media profiler 532 to reflect changes in the length of printing medium available for use as the printing medium is used, such that controller 532 ma alert the user if an inadequate amount of printing medium is available for a particular print job.

As noted earlier, advancement of paper 28 by drive rollers 36 is dependent upon accurate regulation of the tension in paper 28 as it travels past print heads 84. Specifically, changes in the differential tension across the nip point of drive rollers 36 and pinch rollers 38 should be minimized as paper 28 is advanced by drive rollers 36. Tensioning spool 510 and tensioning apparatus 512 provide means for accurately maintaining tension in paper 28, thus minimizing variations in the differential tension across the nip.

Tensioning spool 510 preferably includes a mechanism for securing paper 28 along the length of tensioning spool 510. For example, as seen in FIG. 4, a slot 536 may be provided along the length of tensioning spool 510. The edge of paper 28 is inserted into slot 536 and tensioning spool 510 rotated about its longitudinal axis. As tensioning spool 510 rotates about its axis, paper 28 is secured to tensioning spool 510 along the entire length of tensioning spool 510 by wrap friction. Any other method known in the art for securing paper 28 to tensioning spool 510 would function equally well. For example, paper 28 could be secured to tensioning spool 510 by the use of tape or other adhesive, or mechanical fastening means such as grippers or clamps.

Tensioning apparatus 512, best seen in FIG. 4, uses spring 540 to exert a force on drive shaft 542 which in turn creates tension in paper 28. Spring 540 is preferably a torsion spring wrapped about drive shaft 542. Drive shaft 542 communicates with tensioning spool 510 via timing gears 544 and 546 and timing belt 545 such that when drive shaft 542 rotates, tensioning spool 510 also rotates. Indexing disk 550 is attached to drive shaft 542 and is used to monitor the rotation of drive shaft 542. Indexing disk 550 contains a plurality of index marks 552 which are detected by sensor 554. Indexing disk 550 rotates with drive shaft 542, and by determining the number of index marks 552 passing sensor 554, the rotation of drive shaft 542 and tensioning spool 510 can be monitored and constant tension maintained on tensioning spool 550.

As seen in FIG. 4 and described above, spring 540 is wrapped about drive shaft 542 such that spring 540 exerts a rotational force against drive shaft 542. First end 556 of spring 540 is fixed to shaft 542 by any means known in the art. For example, first end 556 of spring 540 may be attached to shaft 542 by welding, a clamping mechanism, an adhesive, or by forcing first end 556 of spring 540 against a surface extending from the circumference of shaft 542. As shown in FIG. 4, first end 556 of spring 540 is attached to disk 547 which in turn is solidly fixed to shaft 542. Second end 558 of spring 540 is fixed to pulley 560. Drive shaft 542 extends through the center of pulley 560, and pulley 560 rotates independently of drive shaft 542 by means of ball bearing 559. Pulley 560 is connected to tensioning motor 570 via drive belt 572. By rotating pulley 560 with tensioning motor 570, spring 540 may be wound and the potential energy stored in spring 540 may be adjusted to a desired level. The potential energy stored in spring 540 is a function of the spring constant and the distance over which force is applied. Therefore, by rotating pulley 560 (and thus winding spring 540) a known amount, a known potential energy may be stored in spring 540 and a known force will be exerted by spring 540 on drive shaft 542.

To facilitate rotating pulley 560 a known amount and thereby winding spring 540 through a known number of revolutions, tensioning motor 570 is preferably a "stepper" motor which produces angular rotation by "stepping" from one angular position to another. Preferably, one "step" of tensioning motor 570 equals one index mark 552 on indexing disk 550 such that the angular rotation of pulley 560 caused by one "step" of tensioning motor 570 equals the angular rotation of shaft 542 which results when one index mark 552 passes sensor 554.

After winding spring 540 a known amount to achieve a desired force, tensioning motor 570 is shut off, and pulley 560 is held stationary relative to drive shaft 542. Spring 540 thus urges rotation of drive shaft 542 and tensioning spool 510. If paper 28 is not attached to tensioning spool 510, the potential energy of spring 540 will cause tensioning spool 510 to rotate freely, spring 540 will quickly unwind and the potential energy of spring 540 will be reduced to zero. However, if paper 28 is attached to tensioning spool 510, tensioning spool 510 will be unable to rotate freely since it is constrained by paper 28. The force generated by spring 540 will then produce a known web tension in paper 28 across the entire width of paper 28. The tension in paper 28 is a function of the force exerted by spring 540, the ratio of timing gears 544, 546 and timing belt 545, and the radius of paper 28 on tensioning spool 510. As paper 28 is advanced by drive rollers 36, spring 540 will cause tensioning spool 510 to slowly rotate and take up any slack produced in paper 28 by the paper advance. As paper 28 continues to be advanced and tensioning spool 510 continues to rotate, spring 540 will gradually unwind and the force exerted by spring 540 transmitted to tensioning spool 510 will decrease. Therefore, to maintain the tension in paper 28 at a near constant level, spring 540 must be periodically rewound.

After the initial tension in paper 28 is set by winding spring 540 with tensioning motor 570 as described above, controller 532 continues to monitor the rotation of drive shaft 542 via indexing disk 550 and sensor 554. As paper 28 is advanced by drive rollers 36, controller 532 monitors the rotation of drive shaft 542 via indexing disk 550 and calculates the radius of paper 28 on tensioning spool 510. The radius of paper 28 on tensioning spool 510 must be computed because as the radius increases, an increased force must be exerted by spring 540 to maintain a constant web tension in paper 28. As the required force to maintain web tension increases, the amount which spring 540 must be wound around drive shaft 542 also increases. To maintain a constant tension in paper 28, the force exerted by spring 540 must increase proportionally to the radius of paper 28 on tensioning spool 510.

The radius of paper 28 on tensioning spool 510 may be determined by any means known in the art, such as by counting the layers of printing medium as it is wound onto the take-up spool and multiplying by the known thickness of the printing medium, or using an external sensing device to measure the radius. In the preferred embodiment, the radius of paper 28 on tensioning spool 510 is calculated in the following manner: Paper 28 is advanced a predetermined distance by drive rollers 36. As paper 28 is wound onto tensioning spool 510, indexing disk 550 also rotates. The relationship between the rotation of indexing disk 550 and tensioning spool 510 is a function of the size of timing gears 544 and 546 and is a known value. Indexing disk 550 has a known number of index marks 552 about its circumference. By counting the number of index marks 552 which pass sensor 554 during each advancement of paper 28, the number of revolutions or fraction thereof for tensioning spool 510 may be calculated. For example, assume indexing disk 550 has 500 index marks 552 about its circumference and rotates four times for each revolution of tensioning spool 510. Further, assume paper 28 advances in 0.160 inch increments. Now, as paper 28 is advanced, controller 532 counts the number of indexing marks 552 which pass sensor 554. Assume 25 index marks 552 are counted by controller 532. Because four revolutions of indexing disk 550 are required for one revolution of tensioning spool 510, it is known that 2,000 index marks 552 (4 revolutions times 500 index marks/revolution) will pass sensor 554 during one complete revolution of tensioning spool 510. If one paper advancement results in 25 index marks 552 passing sensor 554, tensioning spool 510 must have completed $^{25}/_{2,000}$ths of a revolution. Because the distance of paper advancement is known to be 0.160 inches, it is also known that 0.160 inches equals $^{25}/_{2,000}$ths of the circumference of paper 28 on tensioning spool 510. The circumference of paper 28 on tensioning spool 510 must thus be $^{2,000}/_{25}$ times 0.160 inches, or 12.8 inches. The radius of paper 28 on tensioning spool 510 is thus 12.8 inches/$2\pi$, or 2.04 inches.

In a preferred embodiment, media profiler 530 contains data representing the length of paper 28 on paper supply roll 32. As controller 532 monitors the radius of paper 28 on tensioning spool 510, it also determines the length of paper 28 which has been removed from paper supply roll 32 and the amount of paper 28 remaining on paper supply roll 32. The information in media profiler 530 is then updated by controller 532 to indicate the length of paper 28 remaining on paper supply roll 32. The data in media profiler 530 may be updated continuously, at the completion of each print job, or at some periodic frequency therebetween. Printer 10 may then warn a user if inadequate lengths of paper 28 are available to complete a print job at any given image size or number of copies.

After the radius of paper 28 on tensioning spool 510 has been determined in the manner described above, the force which must be exerted by spring 540 to maintain a predetermined tension in paper 28 may be calculated. Tensioning motor 570 is then activated to wind spring 540 such that the desired force is generated by spring 540. The force exerted by spring 540 may be continuously adjusted, or alternatively the force may be periodically adjusted as spring 540 unwinds and the radius of paper 28 on tensioning spool 510 increases. If the tension in paper 28 need only be maintained within a predetermined range, then only periodic adjustment of the force exerted by spring 540 is necessary to keep the tension within the desired range.

In a preferred embodiment, the force exerted by spring 540 results in a force of approximately 2 pounds or less across the web of paper 28. As discussed above, changes in the differential tension of paper 28 across the nip point of drive rollers 36 and pinch rollers 38 should be minimized as paper 28 is advanced by drive rollers 36. By maintaining the force across the web of paper 28 at a low level, any variations in the force are correspondingly small, and the potential changes in the differential tension across the nip point are small. By thus minimizing the magnitude of possible changes in the differential tension, errors in advancement of paper 28 are minimized.

While tensioning apparatus 512 maintains the tension in paper 28 in a predetermined range as paper 28 advances past print head 84, the tension in paper 28 on the supply spool 30 side of drive wheels 36 preferably remains as close to zero tension as possible. While some prior art printers use friction brakes on the print medium supply roll to maintain nominal tension in the print medium immediately available from the supply roll, friction brakes or similar devices do not provide a constant web tension in the media. Rather, the web tension decreases as the radius of the supply roll decreases. Therefore, supply spool 30 and paper supply roll 32 are preferably supported in a manner which minimizes resistance to rotation. By maintaining the tension in paper 28 near zero on the supply side of the drive rollers 36 and by maintaining a low constant tension in paper 28 on the take-up side of drive rollers 36, any changes in the differential tension across the nip between drive rollers 36 and pinch rollers 38 remains nearly constant. By maintaining a constant differential tension across the nip, variations in the rate of advancement of paper 28 are minimized.

In a preferred embodiment, the use of tensioning apparatus 512 as described above, together with servo drive motor 500 and grit drive rollers 36, allows paper 28 to be advanced by drive rollers 36 to an accuracy of 0.0001 inches. Precise paper advance stepping to an accuracy of 0.0001 inches avoids having to multi-pass print to attain graphics quality images with the resultant slow-down in print speeds.

As best seen in FIG. 3, after the printed image has been created on paper 28 and has been wound onto tensioning spool 510, paper 28 is cut between drive rollers 36 and tensioning spool 510. Paper 28 may be cut by hand by the operator of the printer, or a cutting mechanism may be provided to cut paper 28 along its width. A cutting mechanism may be controlled by controller 532 to automatically cut paper 28 upon completion of a print job. The free end of paper 28 which contains the printed image is guided past heater 516 and quencher 518 and onto take-up spool 514. To reduce cockling of paper 28, heater 516 and quencher 518 are preferably provided with a curved profile, as best seen in FIGS. 2 and 3. The curved profile of heater 516 and quencher 518 tends to stiffen paper 28 against buckling and cockling as paper 28 passes around heater 516 and quencher 518. As the radius of curvature of heater 516 and quencher 518 decreases, the effectiveness in preventing cockling of paper 28 is increased. It is therefore preferable to provide heater 516 and quencher 518 with a radius of curvature which is as small as possible while still maintaining an adequate surface area to create the desired heating and cooling profiles of paper 28. In the preferred embodiment, heater 516 and quencher 518 have a radius of curvature of approximately 2 inches. As noted above, it has been discovered that for heating of images printed with a hot melt ink, the smaller the curvature or outside radius of the heater, the better the control of cockling effects. This is true up to a minimal curvature or outside radius of the heater unit, in the range below 2.0 inches, at which point drag forces make control of media tension much more difficult. Additionally, the ink can fracture or flake from the media due to the more acute wrap angle.

Take-up spool 514 is driven by motor 515 and spur gear drive (not shown) which pulls paper 28 containing the printed image over heater 516 and quencher 518 at a predetermined rate for the medium type. Heater 516 allows the ink previously deposited on paper 28 to melt slightly, liquefy, and thereby spread across the medium surface and securely bond with paper 28. As the ink melts and spreads, the rough surface and "embossed" characteristics of the printed image are reduced. Quencher 518 quickly cools the ink to its solid state after the ink has spread a desired amount.

The temperature of heater 516 is set by controller 532 to achieve the desired amount of spreading of the ink and is dependent upon factors including the melting temperature of the ink and the type of paper 28 or other media used. The temperature of heater 516 is preferably generated by resistance heating, but may be generated by any other means known in the art. In addition, the heating of heater 516 is preferably "zoned" such that when a media of width less than the maximum allowable width is used, only that portion of heater 516 over which the narrower media passes is heated. Quencher 518 preferably is air-cooled to create a heat sink capability suitable for cooling paper 28. Fans are used to direct air over quencher 518 to aid in removing heat from quencher 518. While quencher 518 is depicted as air-cooled, it may also be cooled by any other means known in the art, such as by liquid-cooling.

Minimization of temperature gradients across the width of the image is important to maintain a graphics-quality image. In very large format printers, uneven temperatures are more likely to occur from one side of the media to the other side of the media. Therefore, the material used to form heater 516 and quencher 518 preferably provides a high lateral thermal conductivity, thereby minimizing temperature gradients across the width of the heater 516 and quencher 518.

Heater 516 and quencher 518 cooperate to create a desired heating and cooling profile for paper 28 or other media used. Media profiler 530 preferably contains data representing the preferred heating and cooling profile for the paper 28 which is currently being used in the printer 10. Controller 532 selects the heating and cooling profile based upon information contained in media profiler 530. The information in media profiler 520 preferably determines the temperature of heater 516 and quencher 518, as well as the speed and tension of paper 28 over heater 516 and quencher 518. Optimum heating and cooling of the printed image on paper 28 or other media used may thus be obtained for different printing media.

As noted above, when using contact heating and quenching to remelt the ink image on the print medium, it is important to maintain constant and uniform contact between the media and the heating/quenching elements. Failure to maintain constant and even contact with heater 516 causes the ink to heat and spread non-uniformly on the print medium. Non-uniform spreading of the ink results in uneven color reproduction and visible banding across the image which is unacceptable for graphics-quality images. As the width of the media increases, it becomes more difficult to maintain even and uniform contact between the media and heater 516. For example, as media width increases, the media tends to sag away from heater 516 and quencher 518 so paper 28 may contact heater 516 along the outer edges of paper 28, but not near the center of paper 28. Non-uniform contact may also occur if paper 28 slightly cockles as it is heated, thereby exacerbating the non-uniform contact between paper 28 and heater 516. Also, as media width increases it becomes more difficult to maintain an even tension across the media. That is, it is more difficult to ensure that the tension in the media is consistent from one side to the other such that one side of the media does not droop or sag because it is in lower tension. Such uneven tension across the width of the media could be caused, for example, by misaligned (non-parallel) spools 510 and 514. It is also more difficult to ensure the manufacturing accuracy (i.e., straightness) of take-up spools 510 and 514, and of heater 516 and quencher 518 themselves. The spools 510, 514 and the heater 516 or quencher 518 may be bowed, for example, and the media will not maintain uniform contact with heater 516 as a result.

To overcome the problems relating to non-uniform contact between paper 28 and heater 516, the present invention utilizes a means to maintain contact between paper 28 and heater 516. Preferably, the means to maintain contact comprises independent members which engage paper 28 and urge paper 28 into contact with heater 512. The use of independent members spaced across the width of paper 28 allows slack to be taken up only where slack exists without significantly affecting the overall tension in paper 28. Preferably, there are a plurality of independent flexible members spaced across the width of paper 28. For example, in a preferred embodiment, a plurality flexible fingers 519 (FIG. 3) extend from quencher 518 and engage paper 28 to urge paper 28 into continuous contact with heater 516 and quencher 518. Fingers 519 preferably extend across the width of paper 28, such that each finger 519 engages a corresponding portion of paper 28 and urges the corresponding portion of paper 28 into contact with heater 516 and quencher 518. Fingers 519 preferably operate independently of each other such that the urging force exerted by each finger 519 is independent and unrelated to the urging force exerted by adjacent fingers 519. Fingers 519 are preferably adjustable such that the force exerted by the fingers 519 may be altered individually. In the preferred embodiment, the plurality of flexible fingers 519 are configured and arranged to minimize the possibility of marring the image on paper 29 or paper 28 itself. For example, fingers 519 are positioned to exert pressure on the back side of paper 28 opposite the image, and therefore avoid touching the image. Also, fingers are preferably wide enough to prevent creasing of paper 28 due to an insufficiently wide pressure point formed by fingers 519.

Instead of flexible fingers 519 as shown in FIG. 3, the means to maintain contact between paper 28 and heater 516 may alternatively be comprised of independent idler rollers pressed against paper 28 by a spring or some other force. The means to maintain contact could also be a unitary strip or roller extending across the width of paper 28, the strip or roller exerting a light force on paper 28 such that paper 28 is urged into contact with heater 516 and quencher 518. For example, a string of sufficiently heavy "beads" could be strung across paper 28 such that the weight of the beads urges contact between paper 28 and heater 516. The means for maintaining contact could also be positioned along the path of paper 28 prior to the point at which paper 28 contacts heater 512. For example, fingers 519 could extend from heater 516 to exert pressure on paper 28 before paper 28 passes heater 516. Alternatively, the means for maintaining contact could be positioned both before and after heater 516. As those skilled in the art will recognize, the means for maintaining contact between paper 28 and heater 516 may also comprise many alternative embodiments other than those described above.

Figure 5:
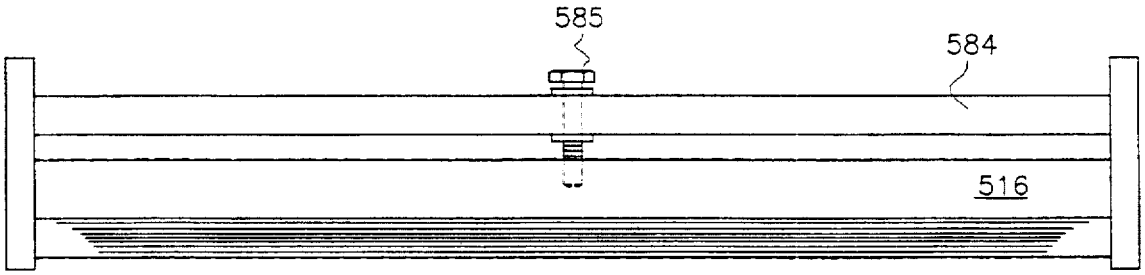
FIG. 5 is a fragmented view of a post-heater adjustment apparatus of the present invention.

If heater 516 or quencher 518 are bowed, thereby causing slack in paper 28, it is possible to adjust the straightness of heater 516 and quencher 518 using the adjustment device depicted in FIG. 5. Bar 584 is mounted above heater 516. Bar 584 is spaced from heater 516, and bolt 585 extends through bar 584 into heater 516. Bolt 585 threadably engages heater 516 such that by turning bolt 585, the center of heater 516 may be drawn toward or moved away from bar 584, thereby altering the "bow" of heater 516. A similar device may be used to adjust quencher 518.

In addition to the desired effects of improving the image quality described above, heater 516 has the undesired effect of expelling moisture from paper 28. The loss of moisture content caused by heating paper 28 causes paper 28 to shrink in a non-uniform manner, i.e., to cockle. In addition to using a curved heating surface as described above, cockling of paper 28 may be reduced by increasing tension in the paper 28 as the printed image is heated. Tension in paper 28 during heating tends to stretch the paper 28 and reduce the effects of any cockling which occurs.

Tensioning apparatus 512 is used to provide tension in paper 28 as the printed image on printing medium is heated. The operation of tensioning apparatus 512 as paper 28 is unwound from tensioning spool 510 is very similar to the operation of tensioning apparatus 512 described above. In particular, as paper 28 is unwound from tensioning spool 510, spring 540 exerts a force which tends to resist removal of paper 28 from the tensioning spool 510. As paper 28 is removed from tensioning spool 510, spring 540 is wound tighter about drive shaft 542 and the force exerted by spring 540 increases. To maintain the tension in paper 28 at a desired and predetermined constant level, controller 532 continuously monitors the rotation of drive shaft 542 and radius of paper 28 on tensioning spool 510 as described above. Periodically or continuously, in the same manner as described above, controller 532 will operate tensioning motor 570 to adjust the potential energy of spring 540 to maintain the desired tension in paper 28 during heating and cooling of the media. Instead of winding spring 540 tighter about drive shaft 542, as described above, when paper 28 is wound onto tensioning spool 510, the direction of tensioning motor 570 is reversed and spring 540 is unwound to decrease the force generated by spring 540 as the radius of paper 28 about tensioning spool 510 decreases.

In a preferred embodiment the tension in paper 28 during heating results in a force across the web in the range of 10 pounds. However, as noted earlier, tensioning apparatus 512 is preferably designed to provide a force in the range of 2 pounds or less across the web during printing. Therefore, one-way drag clutch 590 (FIG. 4) is used to provide an additional resistance force during heating of the printed image. As best seen in FIG. 4, drag clutch 590 is attached to take-up spool 510 opposite tensioning apparatus 512. Drag clutch 590 does not affect tension in paper 28 as paper 28 is advanced by drive rollers 36, and functions only to provide additional tension in paper 28 as paper 28 is removed from take-up spool 510 and transported past heater 516 and quencher 518. Drag clutch 590 provides a constant force in paper 28, preferably in the range of 7 to 10 pounds in addition to the force provided by tensioning apparatus 512. Tensioning apparatus 512 then functions in the manner described above to maintain the force across the web at a desired magnitude.

Although the present invention has been described with reference to preferred embodiments, workers skilled in the art will recognize that changes may be made in form and detail without departing from the spirit and scope of the invention.

What is claimed is:

1. An apparatus for treating an image previously completely formed from hot melt ink on a roll-type printing medium, the apparatus comprising:

a support frame having at least two sets of spaced apart opposing hub members:

an elongate print medium spool member rotatable coupled to the first set of hub members of the support frame so that it rotatably receives a portion of roll-type printing medium containing at least one previously printed image from a image printing apparatus;

a printing medium take up spool rotatably coupled to the second set of hub members of the support frame and disposed to receive the printing medium from the elongate print medium spool member;

printing medium advancement/tensioning means coupled to the elongate print medium spool member and the printing medium take up spool for propelling the printing medium while imparting axial web tension to a printing medium attached thereacross;

an elongate heater means rigidly coupled to the support frame and disposed intermediate a printing medium pathway defined by the elongate print medium spool member and the printing medium take up spool and disposed such that a heated portion of an exterior surface of the heater means controllably manages temperature in response to a control signal, and disposed so that in operation the printing medium momentarily contacts the heated portion of the heater means, for providing a plurality of predetermined printing medium heating profiles, each of the plurality of heating profiles being associated with a respective printing medium type;

a printing medium engagement means for biasing the printing medium to the heated portion of the exterior surface of the heater means;

control means for providing a control signal to the heater means which is responsive to the selected printing medium heating profile.

2. The apparatus of claim 1, further comprising a electronic docking station in electronic communication with the control means, and a self-contained printing medium profiler memory unit associated with the printing medium for storing and providing information related to characteristics associated with the printing medium, wherein the control means selecting the predetermined heating profile as a function of information provided by the printing medium profiler memory unit and wherein the electronic docking station is constructed so that a selected profiler memory storage unit is manually disengageable from the control means.

3. The apparatus of claim 1, wherein the control means, the tensioning means, and the heating means are configured for providing a predetermined printing medium web tension and a predetermined heat to create a predetermined heating profile for the printing medium.

4. The apparatus of claim 1, wherein the heater further comprises a printing medium bow tension adjustment means for creating a slight arc to the elongate heater means and thereby improving the momentary physical contact between the printing medium during operation of the Printing advancement/tensioning means.

5. An apparatus for maintaining constant contact between a surface and a material web having a width moving past the surface, the apparatus comprising:

a plurality of independent flexible fingers spaced across the width of the web, each of the plurality of flexible fingers associated with a respective portion of the web, the flexible fingers deforming independently to engage the respective portion of the web and urge the web into contact with the surface, and a surface tensioning apparatus for imparting a slight arc to the surface at the point of contact between the surface and the material web moving thereacross.

6. An apparatus for use with a large format hot melt ink jet printer to remelt ink forming an image on a printing medium comprising:

a printing medium transport means for moving a printing medium carrying an image formed from solidified hot melt ink from a printing medium supply to a printing medium take-up mechanism;

a heater having a heating surface positioned between the printing medium supply and the printing medium take-up mechanism, the heating surface having a width at least as great as a width of the printing medium, the heater being operable to heat the printing medium as the printing medium moves from the printing medium supply to the take-up mechanism; and a means for engaging the printing medium to maintain constant and uniform contact between at least a portion of the printing medium and the heater surface across the entire width of the printing medium, wherein said means for engaging includes at least two separate sub-means, the first for cross-web biasing the printing medium to the heater, and the second for axially tensioning a portion of the printing medium resident between the printing medium supply and printing medium take-up mechanism.

7. The apparatus of claim 6, wherein the means for engaging the printing medium comprises a plurality of independent members, the members spaced across the width of the printing medium for independently engaging the printing medium and urging the printing medium into contact with the heating surface, and a spring-loaded tensioning assembly to impart back-tension to at least one of the printing medium supply and printing medium take-up mechanism.

8. The heater of claim 7, wherein the independent members comprise a plurality of flexible fingers, each of the plurality of flexible fingers associated with a respective portion of the printing medium, the flexible fingers deforming independently to engage the respective portion of the printing medium and urge the printing medium into contact with the heating surface.

9. The apparatus of claim 7, wherein the flexible member is positioned between the heating surface and the printing medium take-up mechanism.

10. The heater of claim 7, wherein the flexible member is positioned between the heating surface and the printing medium supply.

11. A method of first printing a digital image on a printing medium with a hot melt ink jet printer apparatus and thereafter curing the digital image with heat to briefly re-melt the hot melt ink prior to cooling the digital image to set the image onto the printing medium, comprising the steps of:

providing a hot melt ink jet printer comprising:

a printing medium supply assembly for supplying a length of roll-type printing medium to receive a printed image, the printing medium having a first side and a second side, and wherein a uniform hot melt ink emulsion coating covers the first side;

at least one printing head for depositing hot melt ink on the first side of the printing medium;

a printing medium advancement mechanism for advancing the roll-type printing medium past the printing head;

a take-up mechanism for collecting a portion of the roll-type printing medium after it has passed the printing head; and a heating and quenching mechanism having a heating portion and a cooling portion for first heating and thereafter cooling the hot melt ink forming the printed image on the printing medium;

supplying the printing medium to the advancement mechanism at a first printing medium tension;

advancing the printing medium past at least one printing head at a predetermined rate;

depositing ink on the first side of the printing medium with at least one printing head as the printing medium is advanced past the printing head;

winding the printing medium containing the printed image on a first take-up spool while maintaining a second printing medium tension in the printing medium between the advancement mechanism and the take-up mechanism;

cutting the printing medium after the image has been printed such that the printed image is contained on the first take-up spool;

guiding the printing medium containing the printed image from the first take-up spool to a second take-up spool,the second side of the printing medium contacting the heating and quenching mechanism as the printing medium travels to the second take-up spool; and heating the printing medium as it passes the heating portion of the heating and quenching mechanism, thereby causing the hot melt ink of the printed image to briefly melt; and cooling the printing medium as it passes the cooling portion of the heating and quenching mechanism, thereby causing the hot melt ink of the printed image to set.

12. A method for treating an image formed on a printing medium from a plurality of propelled hot melt ink droplets, by reheating the image until the hot melt ink briefly re-melts, comprising the steps of:

providing a plurality of predetermined printing medium heating profiles, each of the plurality of heating profiles having a printing medium type associated therewith;

identifying the type of printing medium to be treated;

selecting the predetermined heating profile for the printing medium to be treated;

applying a slight axial tension to the printing medium;

advancing the printing medium so that a portion of the printing medium which has an image formed thereon advances along a printing medium heat treatment pathway; and heating the printing medium according to the selected predetermined heating profile so that the image formed from a hot melt ink and resident thereon briefly re-melts and each discrete droplet of said hot melt ink flows to an adjacent available space upon the printing medium so that the droplets combine to form a continuous bed of hot melt ink forming the image.

13. The method of claim 12, further comprising:

providing information about thermal, size, and thickness characteristics associated with the printing medium to be treated.

14. The method of claim 13, wherein selecting the predetermined heating profile for the printing medium to be treated is a function of the information provided about characteristics associated with the printing medium.

15. A printing medium handling system for moving printing medium past a printing head to form images thereon, the printing medium handling system comprising:

receiving means for receiving a supply of roll-type printing medium on which images are to be printed, the roll-type printing medium having inherent physical printing medium characteristics associated therewith;

a printing medium profiler memory unit associated with the supply of roll-type printing medium for providing information relating to the inherent physical characteristics associated with the supply of roll-type printing medium; and a controller coupled to the printing medium profiler for controlling movement of roll-type printing medium as a function of the information provided by the printing medium profiler.

16. The printing medium handling system of claim 15, further comprising a heater linked to the controller for providing a predetermined printing medium heating profile associated with the printing medium characteristics, the controller being coupled to the heater for controlling the heating profile of the printing medium as a function of the information provided by the printing medium profiler.

17. The printing medium handling system of claim 16, wherein the heater is capable of providing a plurality of predetermined printing medium heating profiles, each of the plurality of heating profiles being associated with a respective printing medium type, the controller selecting a predetermined heating profile as a function of information provided by the printing medium profiler.

18. The printing medium handling system of claim 15, wherein the printing medium profiler memory unit comprises a memory unit selected from a plurality of memory units, the information provided by each memory unit corresponding to a predetermined type of printing medium.

19. The printing medium handling system of claim 15, wherein the information provided by the printing medium profiler is indicative of the printing medium type and a printing medium dimension.

20. The printing medium handling system of claim 15, wherein the controller is coupled to the printing head for controlling the formation of printed images on the printing medium as a function of information provided by the printing medium profiler memory unit.

21. A printing medium handling system for moving printing medium past a printing head to form images thereon, the printing medium handling system comprising:

receiving means for receiving a supply of printing medium on which images are to be printed, the printing medium having medium characteristics associated therewith;

a printing medium profiler associated with the supply of printing medium for providing information relating to the characteristics associated with the supply of printing medium;

a controller coupled to the printing medium profiler for controlling movement of printing medium as a function of the information provided by the printing medium profiler;

and further comprising:

a printing medium advancement mechanism for advancing the printing medium past the printing head; and a printing medium take-up mechanism for collecting the printing medium after is has passed the printing head, wherein the controller is coupled to the printing medium advancement mechanism and the printing medium take-up mechanism controlling the movement of the printing medium from the supply of printing medium to the printing medium take-up mechanism.

22. A printing medium handling system comprising:

a printing medium supply assembly configured to receive a supply of a printing medium, the printing medium having printing characteristics;

at least one printing head, a printing medium advancement mechanism for advancing printing medium past the printing head, and a printing medium take-up mechanism for collecting printing medium after it has passed the printing head;

at least one storage unit associated with the printing medium, the storage unit adapted for providing information concerning the characteristics associated with the respective printing medium; and a controller means coupled to the storage unit, the printing head, the advancement mechanism, and the take-up mechanism, for controlling movement of the printing medium as a function of the information provided by the memory unit.

23. The paper handling system of claim 22, wherein each storage unit is one of a plurality of storage units, each of the plurality of storage units corresponding to a predetermined type of printing medium, each storage unit storing information concerning characteristics about the associated printing medium, the controller operating the printing head, the advancement mechanism, and the take-up mechanism as a function of the information stored in the storage unit.

24. The paper handling system of claim 22, further comprising:

a heater for providing a predetermined printing medium heating profile, the controller means coupled to the heater for controlling the heating profile of the printing medium.

25. The printing medium handling system of claim 24, wherein the heater is capable of providing a plurality of predetermined printing medium heating profiles, each of the plurality of heating profiles being associated with a printing medium type, the controller means selecting a predetermined heating profile as a function of information provided by the memory unit.

26. A printing medium handling apparatus comprising:

a frame;

a printing medium supply assembly releasably attached to the frame, the supply assembly carrying a supply of a printing medium having printing medium characteristics;

at least one printing head;

a printing medium advancement mechanism for advancing the printing medium past the printing head;

a first printing medium take-up mechanism for collecting printing medium after it has passed the printing head;

a heater for heating the printing medium after it has been collected by the first take-up mechanism;

a second printing medium take-up mechanism for advancing the printing medium past the heater and collecting the heated printing medium;

the printing medium supply assembly, printing head, printing medium advancement mechanism, first take-up mechanism, heater, and second take-up mechanism configured and arranged on the frame to allow printing medium to move consecutively from the printing medium supply assembly past the printing head and onto the first take-up mechanism, and then from the first take-up mechanism past the heater and onto second take-up mechanism;

at least one memory unit adapted for storing information indicative of the characteristics of the printing medium; and a controller means electrically connected to the memory unit, the printing head, the printing medium advancement mechanism, the first take-up mechanism, the heater, and the second take-up mechanism, for operating the printing head, printing medium advancement mechanism, first take-up mechanism, heater, and second take-up mechanism based on the information supplied by the memory unit.

27. The printing medium handling apparatus of claim 26, wherein the memory unit is selected from a plurality of memory units, each memory unit having a printing medium type associated therewith.

28. The printing medium handling apparatus of claim 26, wherein the memory unit is a component of and integrally formed as a portion of the printing medium supply assembly.

29. A method of moving a printing medium past a printing head to form printed images, the method comprising the steps of:

providing a supply of printing medium to be printed, the printing medium having characteristics associated therewith;

providing a manually replaceable printing medium profiler memory unit associated with the supply of printing medium for providing information indicative of characteristics associated with the supply of printing medium; and controlling the movement of the printing medium under a predetermined axial web tension and as a function of the information provided by the manually replaceable printing medium profiler memory unit so that when the manually replaceable printing medium profiler is replaced a different sequence for controlling the printing medium occurs.

* * * * *